US005208418A

United States Patent [19]

Toth et al.

[11] Patent Number: 5,208,418

[45] Date of Patent: May 4, 1993

[54] ALIGNING METHOD FOR A FIRE CONTROL DEVICE AND APPARATUS FOR CARRYING OUT THE ALIGNMENT METHOD

[75] Inventors: Peter Toth, Kloten; Peter Schueepp, Illnau, both of Switzerland

[73] Assignee: Oerlikon-Contraves AG, Zurich, Switzerland

[21] Appl. No.: 294,489

[22] PCT Filed: May 2, 1988

[86] PCT No.: PCT/EP88/00365

§ 371 Date: Dec. 9, 1988

§ 102(e) Date: Dec. 9, 1988

[87] PCT Pub. No.: WO88/08952

PCT Pub. Date: Nov. 17, 1988

[30] Foreign Application Priority Data

May 15, 1987 [CH] Switzerland ..... 01881/87

[51] Int. Cl.[5] ..... F41G 3/02

[52] U.S. Cl. ..... 89/41.07; 89/41.05; 89/41.14; 89/41.17; 33/235

[58] Field of Search ..... 89/41.05, 41.06, 41.07, 89/41.14, 41.17, 41.22; 33/237, 235

[56] References Cited

U.S. PATENT DOCUMENTS

| | | | |
|---|---|---|---|
| 3,288,030 | 11/1966 | Lind | 89/41.07 |
| 3,415,157 | 12/1968 | Marchisio et al. | 89/41.06 |
| 3,798,795 | 3/1974 | Michelsen | 89/41.05 |
| 3,803,387 | 4/1974 | Lackowski | 89/41.14 |
| 3,918,813 | 11/1975 | Rossiter | 33/285 |
| 3,955,292 | 5/1976 | Robertsson | 434/22 |
| 4,020,739 | 5/1977 | Piotrowski et al. | 89/41.06 |
| 4,418,361 | 11/1983 | Bagnall-Wild et al. | 89/41.05 |
| 4,570,530 | 2/1986 | Armstrong | 89/41.05 |
| 4,606,256 | 8/1986 | De'Ath | 89/41.06 |
| 4,760,770 | 8/1988 | Bagnall-Wild et al. | 89/41.06 |

FOREIGN PATENT DOCUMENTS

| | | | |
|---|---|---|---|
| 2105016 | 8/1979 | Fed. Rep. of Germany | 89/41.22 |
| 2951108 | 7/1981 | Fed. Rep. of Germany . | |
| 2491611 | 4/1982 | France | 89/41.06 |
| 2112965 | 7/1983 | United Kingdom . | |
| 2123935 | 2/1984 | United Kingdom | 89/41.14 |

*Primary Examiner*—Stephen M. Johnson
*Attorney, Agent, or Firm*—Sandler Greenblum & Bernstein

[57] ABSTRACT

The method and apparatus for determining and correcting alignment errors between fire control devices and weapon systems are distinguished by the following features. Target measuring sensors are mounted on guns which are mounted on servo-controlled mounts, and the sensor line of sight of each target measuring sensor is aligned with the line of sight of the gun. The guns containing the target measuring sensors are aligned to a common measuring target using a target tracking device. A deviation between the measured position of the common measuring target and the position of the line of sight of the target measuring sensor is detected in the target measuring sensor of the gun which is controlled by the target tracking device. This deviation is evaluated and processed to determine an alignment error vector taken into account during control of the gun. Control signals used during a firing operation are corrected on the basis of the alignment error vector.

23 Claims, 3 Drawing Sheets

ALIGNING METHOD FOR A FIRE CONTROL DEVICE AND APPARATUS FOR CARRYING OUT THE ALIGNMENT METHOD

BACKGROUND OF THE INVENTION

The present invention relates to correcting alignment errors between the mounts for mounting fire control devices and guns of a weapon system.

In its more particular aspects, the present invention specifically relates to correcting alignment errors between the mounts for mounting fire control devices and guns of a weapon system, and thus, generally relates to the field of detecting and measuring as well as compensating for errors. In particular, the present invention is directed to determining and correcting errors which result from mechanical or dimensional manufacturing tolerances as well as changes in the mounts and seatings of fire control devices and associated weapons or guns. The determination and correction of such errors is carried out for the purpose of accomplishing a precise mutual alignment of the fire control devices and the associated weapons or guns relative to each other.

The interaction or cooperation of fire control devices or systems with one another, of fire control devices or systems with weapons or guns controlled thereby, and of weapons or guns with one another, wherein these systems are or have to be coordinated in relation to one another, is generally impaired by so-called alignment errors. Alignment errors are errors which include a deviation from a defined (common) geometry, regardless of whether these errors occur during construction or after construction due to changes in the support base, as can be the case, for example, on ships.

In order to rectify alignment errors caused by mechanical inaccuracies, these errors must first be measured, then corrected and appropriately subsequently remeasured in order to detect time-dependent errors and possibly corrected.

SUMMARY OF THE INVENTION

Therefore, with the foregoing in mind it is a primary object of the present invention to correct alignment errors between the mounts for mounting fire control devices and guns of a weapon system in a manner not afflicted with the drawbacks and limitations of the prior art.

Another and more specific object of the present invention is directed to correcting alignment errors between the mounts for mounting fire control devices and guns of a weapon system while rectifying alignment errors in a comparatively simple manner and in a manner such that the alignment error rectification can be unlimitedly frequently repeated.

It is a further significant object of the present invention to correct alignment errors between the mounts for mounting fire control devices and guns of a weapon system while rendering possible detection and correction of time-dependent errors including comparatively slow variations with time.

Another still important object of the present invention aims at correcting alignment errors between the mounts for mounting fire control devices and guns of a weapon system while taking due account of dimensional deviations in the system components from a desired or ideal geometric configuration during servo control of the aforementioned mounts.

Now in order to implement these and still further objects of the invention, which will become more readily apparent as the description proceeds, the method of the present development is manifested, among other things, by the features that, (a) a target measuring sensor is attached to a gun which is mounted at a servo controlled mount, and the target measuring sensor line of sight is aligned to the line of sight defined by the gun;

(b) the guns containing target measuring sensors are aimed by means of a target tracking device and target tracking devices are aimed at a common measuring target or (b') the guns containing target measuring sensors and aiming means, as well as target tracking devices are aimed at a common measuring target;

(c) a deviation is detected between the position of the common measuring target and the position of the target measuring sensor line of sight at the target measuring sensor of the gun which is controlled by the target tracking device, or (c') a deviation is detected between the position of the common measuring target as determined by the target tracking device, and the position of the common measuring target as determined by a further target tracking device or the target measuring sensor and aiming means of the gun;

(d) the positional deviation data are evaluated for obtaining an aiming error vector and the aiming error vector is taken into account in the servo control of the gun; and (e) the control signals produced during a firing operation are corrected by means of the aiming error vector.

Generally speaking, the inventive apparatus is intended for correcting alignment errors between the mounts for mounting fire control devices and guns of a weapon system.

To achieve the aformentioned measures, the inventive apparatus, in its more specific aspects, comprises:

(a) target measuring sensors which are arranged at guns mounted at servo controlled mounts and each of which defines a target measuring sensor line of sight which is aligned to the line of sight of the gun at a precisely known angle;

(b) target tracking devices and guns which are operatively connected with the target tracking devices via gun servo control means and which guns contain respective ones of the target measuring sensors, for detecting a common measuring target and for aiming the gun at the common measuring target; or (b') guns which are equipped with target measuring sensors and aiming means, i.e. means for target tracking, and target tracking devices for detecting a common measuring target;

(c) means for detecting a deviation between the position of the common measuring target as determined by the target tracking device and the position of the common measuring target as determined by means of the target measuring sensor of the gun or the position of the common measuring target as determined by means of a further target tracking device; and (d) data processing means for evaluating positional deviation data and for processing the aiming error vector for the gun servo control.

The invention derives from or is based on the following concept idea: it is known that mechanically caused alignment errors of the components of inertial navigation devices can be not only mechanically adjusted or compensated but also corrected using an analytical or computational compensating process. For this purpose, the mechanical errors are determined by measuring, for example, the deviation from the ideal orthogonality of the main or principal axes and directly linking or combining the measured errors as intrinsic parameters, which are like "personal" error values, with control and/or regulation data and correcting such data in real-time processing by compensation in controlling-/regulating means. The intrinsic error data accompany or are associated with a respective mechanical device and are supplied to the controlling or regulating means, for example, in the form of a log and can be directly implemented or introduced into the computation. This type of process is known and is used in connection with the "strapdown inertial navigation" technique, i.e. restrained inertial navigation technique.

Further to this, a so-called zero test is known from antiaircraft artillery, in which the alignment of guns and aiming means or a fire control system to a common target is checked with the exclusion of dynamic compensation aiming-off allowance and ballistic influences.

If a zero test is carried out on an identical measuring target using two respective devices provided with measuring means, a deviation including device and system errors such as mounting errors, can be observed for each measurement. The zero test therefore determines an observable general error made up of various error components. A zero test for use in connection with the invention is understood to comprise a number of measurements in various spatial directions. An alignment error vector can then be computed from those determined deviations and the scalar components of this vector are the various apparatus and systems errors which have been considered.

For the following discussion of an exemplary embodiment of the measuring and controlling procedure according to the invention, it is important to differentiate clearly between a firing operation and the measuring operation which is the implementation of the measuring process. During the firing operation, the data obtained using the measuring process are follow-up movement of the mounts and taken into account during the normal ballistic and geometric computations or calculations. The measuring operation on the contrary ignores all ballistic aspects and is only concerned with the geometry of the axes of measurement in space, i.e. with their relation to one another and their deviations from the desired geometry. During the measuring operation, deviations are therefore determined, and therefrom the desired alignment error vector is computed or calculated and made available for subsequent use in the control of the mounts during the firing operation.

The procedure for using the invention is described below with reference to a warship as a concrete example.

All the fire control devices and guns which have been mounted on mounts and placed on platforms or seatings as well as the platforms or seatings themselves have normal mechanical tolerances.

Part 1 of the procedure:

Fire control devices and guns are manufactured with economically acceptable, normal tolerances and before being mounted on the surfaces of the platforms or seatings are measured precisely, as far as possible at the place of production. Mechanical adjusting devices are not provided. The normal mechanical tolerances or allowances produce deviations from the desired geometry which are still too big relative to the precision required. However, the precisely measured deviations or dimensional deviations data should henceforth be capable of being taken into consideration electronically, i.e. by means of a computer in both the measuring and firing operations.

Part 2 of the procedure:

After the fire control devices and guns have been installed at their platform or seatings on the ship, for example, while still in the dock, the alignment measurements, i.e. the determination of the positions of the platforms or seatings relative to one another are carried out with the usual measuring precision, taking into account the measuring results which are already known. Such alignment measurements detect the original approximate or coarse position of about one degree of angle at a measuring accuracy of about 2 minutes of angle. The results of these alignment measurements, i.e. relative positional data are henceforth considered analytically in the measuring and firing operation.

Part 3 of the procedure which constitutes the inventive part of the measuring process;

The precision measurement which now follows during the measuring operation is independent of the position of the ship and can be carried out at sea. All the included or integrated devices carry target measuring sensors and take into account the results of parts 1 and 2, when measuring a common measuring target in various positions relative to the devices. The remaining inaccuracies or residual errors which were not detected by the measurement in part 2, are also determined in a kind of regression or error compensation calculation with a measuring accuracy of a few tenths of minutes of angles from a sufficient number of position deviations determined in various directions, and are hence forth taken into account in the measuring and firing operations.

Slow changes in the geometry of the ship, which among others, also cause alignment errors, can be determined and corrected by repeated implementation of part 3. These changes arise, for example, when the ship is loaded and unloaded and are generally reversible. Remaining changes or alterations due to external influences such as running aground, collisions, strong vibrations but also normal aging can be detected and also taken into account. Using the procedure according to the invention, it is possible to maintain a high precision of the fire control throughout the entire lifetime of the ship. It is a particular advantage of this measuring operation that it can be carried out on the open sea without shutting down or placing out of service the ship as is the common procedure in part 2.

As already mentioned above, all the parts which are produced mechanically, such as the mounting devices and platforms or seatings, have mechanical tolerances, but these no longer determine the accuracy of this system during the firing operation, since alignment error data obtained during the inventive precision measuring operation are stored in a fire control computer so that they may be henceforth taken into account in the calculations of coordinates. The alignment error data have the effect of correcting misalignment in real-time and can be remeasured and reset from time to time to follow the changing dimensional conditions of a ship.

Naturally, not all mechanical dimensions and their tolerances are of the same significance with respect to the accuracy of alignment, and it should also be noted here that some work pieces can be manufactured very easily within very narrow tolerances, and others on the contrary can only be so manufactured with a high expenditure or not at all.

In quite general terms, three groups of work pieces can be differentiated and are characterised by the influence of their tolerances on the quality of the system:

Work pieces with dimensions whose production or manufacturing tolerances are such that they:

1. do not have a negative influence on the quality of the system. In these cases, the dimensional deviations can be ignored;
2. do impair the quality of the system, but not to such a great extent that special detailed consideration is necessary. The resulting inaccuracies are taken into account as statistical quantities;
3. impair the quality of the system to an unacceptable extent. In these cases, the intrinsic parameters are determined by measurements which have the necessary accuracy. The parameters are considered as dimensional deviation data.

These considerations do not only apply to individual work pieces but also to incorporated or assembled individual work pieces or structural units with respect to which an overall measurement occurs in the case of group 3.

The mounting devices, for example, the mount of a fire control device or sensor or a weapon system or, effector are likewise manufactured with the usual tolerances and are subsequently measured accurately while still in the factory and the intrinsic parameters are determined. High-precision measuring means are used for this purpose so that the determined results and therefore also the parameters lie within the required general tolerances. An increase in precision is more easily achieved by measuring and considering the dimensions than by narrow manufacturing tolerances and mounting instructions. The evaluation of the zero test measurements should remain restricted to as few parameters as possible. It follows therefrom that as many intrinsic parameters as possible are determined beforehand—while still in the factory—with a sufficiently high accuracy. The time-invariant system parameters can be treated in this manner.

On the other hand, the geometry of the superstructural parts on the ship, i.e. the alignment of the mounting devices relative to one another, changes with time or only occasionally. The geometry includes the parameters which specify the relation between the individual mounting devices and that of the mounting devices to the ship, for example, alignments, inclinations or obliqueness, etc. They are monitored with the aid of the procedure according to the invention and the deviations which occur with time are correspondingly compensated for.

After the fire control devices and guns have been installed at the platforms or seatings on the ship, the usual alignment operations are undertaken using clinometers, theodolites and so on, and a measurement of the approximate or coarse position is carried out according to part 2.

For the subsequent precision measurement according to part 3, which is substantially one set of zero test measurements, a common measuring target which is independent of the co-ordinates of the ship, is measured by all the sensors of the mounting device, taking into account the results of the factory measurement and the approximate or coarse position measurement. These measurements produce the deviations from the common measuring target which can be observed e.g. at the gun, these deviations constituting the result of the remaining alignment errors, taking into account the parameters measured so far.

A special feature of the inventive method can also be seen in that an estimation of the system quality is possible in addition to the determination of the parameters. For this purpose, the residual errors remaining from the deviations observable e.g. at the gun after the results from part 3 have been applied, are calculated and statistically evaluated. The residual errors are a consequence of the fact that, on the one hand, only the most important but not all parameters are estimated and considered and that, on the other hand, the measuring means are not ideal. Statistical criteria for the system quality are therefore derived from the residual errors.

For the precision measurement with the aid of a zero test, the tracking sensors or target tracking devices of the fire control devices and target measuring sensors like, for example, TV cameras arranged on the guns are used as measuring means. The guns can of course also be provided with other target measuring sensors e.g. lasers; however, it is important that the line of sight of the selected target measuring sensor is in a precisely known, fixed position, preferably determined by the factory measurements, with respect to the line of aim of the associated gun, e.g. parallel thereto. The common measuring target is then measured with these sensors, i.e. the deviations in the position of the measuring target, as measured by the various sensors in relation to one another, are determined. For this purpose, a target measuring or tracking sensor of the target tracking device can determine the position of the common measuring target and control the associated gun. The offset between the target and the line of sight then becomes immediately visible in the target measuring sensor of the gun. The gun can, however, also be provided with aiming or target tracking means and can track the common measuring target independently and determine its position; i.e., it is itself a target tracking device. The offset or deviation between the results obtained by the aforementioned independent target tracking devices represents the difference between the different independently measured positions of the common measuring target.

A preferred construction of a target measuring sensor at the gun is a TV camera having a fixed focal length and a depth of focus to infinity (fixed focus TV camera) and containing a two-dimensional arrangement or array of light-sensitive recording cells in the image plane, e.g. so-called charge coupled devices (CCD array). A camera of this type has the advantage of a high gauging accuracy without using a regulating device. The image picked up in this way can be scaled and standardized or calibrated. A swing-over lens can serve for a possible focussing on targets in the short range of, for example, less than 100 m.

The offset or deviation measurement occurs in an advantageous manner by measuring a standardized or calibrated television image produced by a camera of the type mentioned above. The line of sight of the camera, which is positioned in a fixed known direction with respect to the gun line of sight or sensor line, for example, parallel thereto, is marked for this purpose by a cross line or reticule. A marker is also superimposed and can be positioned with the aid of a joystick or similar means for moving a cursor on a display screen such as, for example, a mouse, roller ball, or cursor deflection keys. These markers are circuit-generated during evaluation of the image produced by the charge coupled devices and are not superimposed only when reproduced on the display screen or monitor, thus ensuring gauging accuracy.

During the zero test, the target generally appears in the monitor display or picture with a certain offset or deviation from the cross line or reticule and this offset must be recorded. The recordal or registration occurs by positioning the marker on the target and then actuating a key switch; the momentary offset, which is known from the marker generator, is thereby stored.

The quality of the measurement depends on the "visibility" of the common measuring target for the various sensors used in the system. For example, if the target is tracked using radar means and measured in a TV or video image of a gun camera, it is important that the radar center of the common measuring target is known and visible in the TV or video image. Analogously, an infrared center should be defined if IR or infrared sensors are used. Suitable common measuring targets are, for example, Lüneberg lens, radar corner reflectors with heating and illumination means etc.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
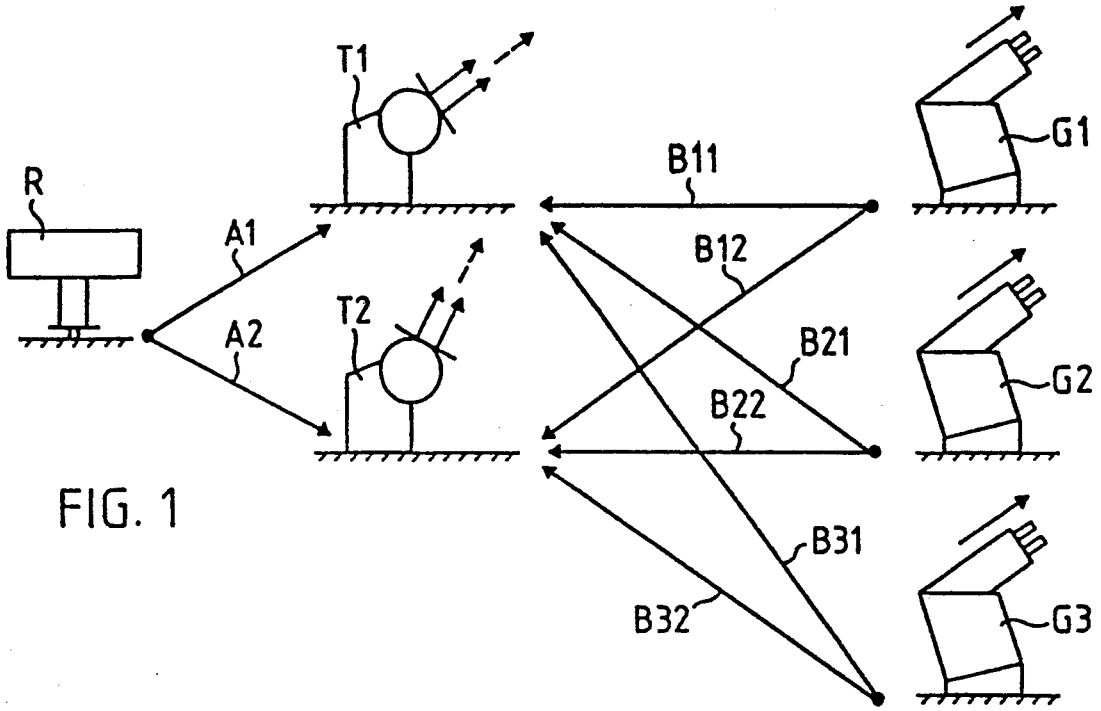
FIG. 1 shows schematic illustration of the positional network of sensors and effectors in a system containing an exemplary embodiment of the inventive apparatus for carrying out an exemplary embodiment of the inventive method.

Describing now the drawings, it is to be understood that only enough of the construction of the apparatus has been shown as needed for those skilled in the art to readily understand the underlying principles and concepts of the present development, while simplifying the showing of the drawings. Turning attention now specifically to FIG. 3 of the drawings, there has been shown therein by way of example and not limitation a common measuring target Z and its positional relationship with respect to a fire control device T2 and a gun G3. This common measuring target Z is radar-reflective or "visible" to target tracking sensors (FLIR, Laser) and guided e.g. by means of a helicopter at various heights around the ship, which is at sea. The common measuring target Z is continuously measured by the target tracking sensors. It is here pointed out, there can be selected substantially equidistant azimuth angles and/or elevations for the positions of the common measuring target relative to the gun to be aimed. The distance is preferably selected to be about 1.5 km, and the elevation preferably varies between 5 and 70 degrees. The common measuring target Z must be brought into various positions relative to the ship. This can be effected, for example by means of a helicopter 10, which carries the common measuring target or target body Z on a suspending wire or cable 12 about 80 m long. Commencing at a height of about 150 m, the helicopter 10 circles the ship and the common measuring target Z tracked and measured by one or more target tracking sensors. This process continues at greater and greater heights, the common measuring target Z being continuously measured. In the case of the measurement between an aiming or fire control device like the fire control device T2 containing radar target tracking device and a gun like the gun G3, the gun is controlled by the aiming or fire control device T2 and aimed at the common measuring target Z which is observed and displayed by the target measuring sensor B, for example a TV camera associated with the gun G3. The measured values obtained at the various angles of measurement are comparison values used for comparing two respective sensors. A computer determines the alignment errors, for example, between radar sensor axes and gun sensor axes. An alignment error vector is determined with increasing accuracy and is continually taken into account, by means of a continuously running recursive calculation or a repeated regression calculation. The errors remaining from the approximate or coarse alignment according to part 2 are eliminated. The deviations can be illustrated in a diagram.

In this way, or by displaying code numbers or digits, the improvement in the precision is continuously controlled. An assumed time-independent error, for example, can also be checked for its actual time independence according to a value determined for the above mentioned system quality, since the panoramic target measurements can be repeated at arbitrary time intervals.

Further details of the invention will result from the following analysis with reference to the figures of the drawing.

Figure 2:
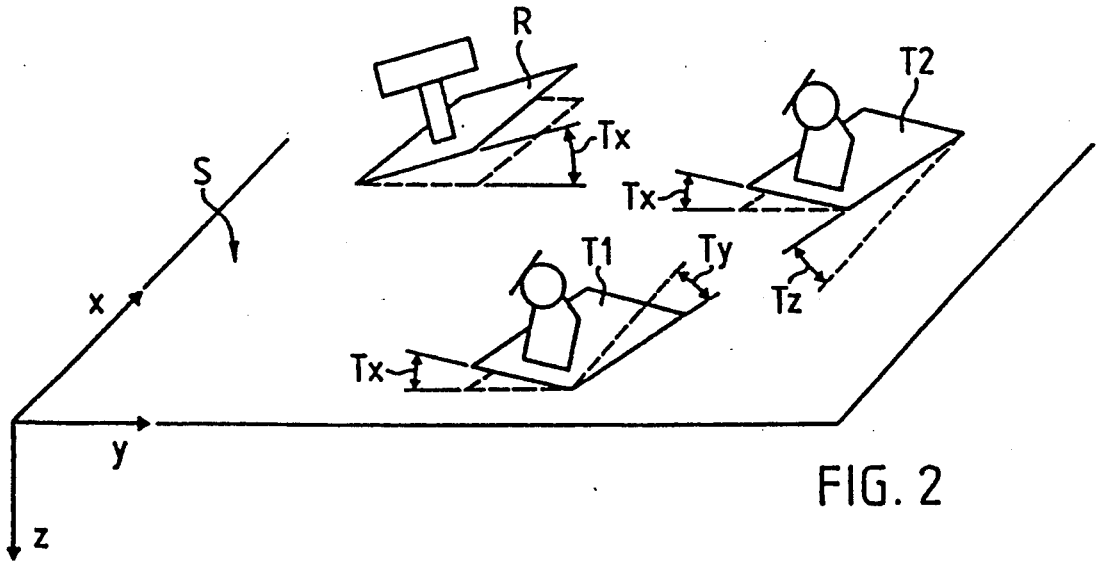
FIG. 2 schematically illustrates mechanical misalignments occurring in the system shown in FIG. 1.

FIG. 1 shows a mounting arrangement for three sensor groups G, T and R. These are a surveillance radar R, two aiming or fire control devices T1 and T2 containing respective, for example, radar target tracking devices, and three computer-controlled guns G1, G2 and G3. All the mounts are positioned at their respective platforms or seatings and are aligned approximately by mechanical means. Possible alignment errors are tilt angles Tx, Ty, Tz, and small angles of inclination of the platforms or seatings relative to the ship coordinate system about the axes x or y or z, as schematically shown in FIG. 2 for different devices, as well as small rotations of the coordinate system of the upper mount relative to the ideal coordinate system, resulting from e.g. residual errors in the measurements according to part 1 of the entire process.

Individual or multiple alignment error vectors B11 (gun G1 to aiming or fire control device T1), B12 (gun G1 to aiming or fire control device T2), B21, B22, B31, B32, A1 (aiming or fire control device T1 to surveillance radar R), A2 (aiming or fire control device T2 to surveillance radar R) can be obtained with each panoramic target measurement. The measurements of the sets of data, from which the alignment error vectors are calculated, can be combined with one another time wise. A specific alignment error vector, e.g. B12, produces for the gun G1, for example, the tilt relative to T2 and the elevation zero offset of the sensor line of sight.

The process for determining an alignment error vector will now be explained herein below using the relation between an individual gun and an individual aiming or fire control device.

Figure 3:
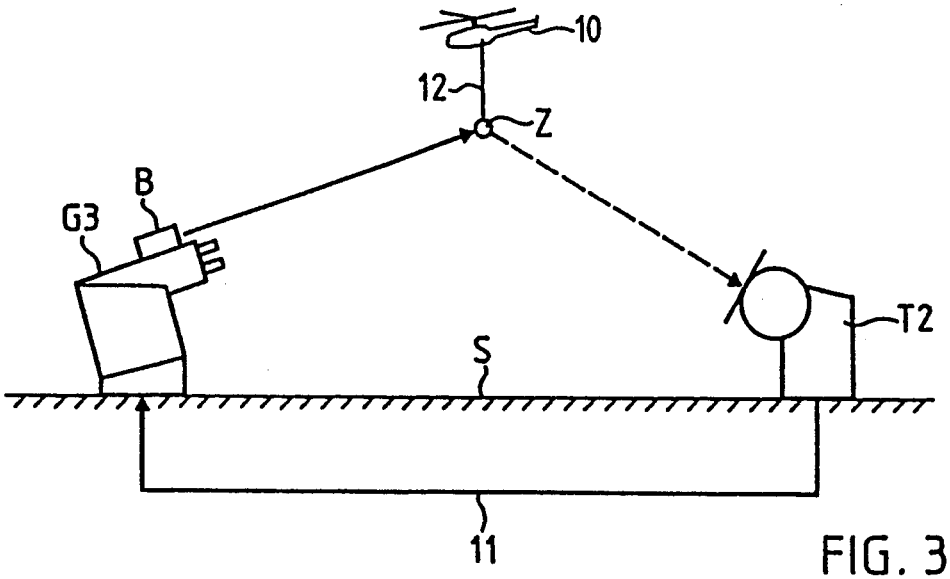
FIG. 3 shows a schematic arrangement for carrying out a single observation by the exemplary embodiment of the inventive method.

This is shown schematically in an example in FIG. 3 which illustrates the gun G3 with its TV target measuring sensor B, the aiming or fire control device T2 which controls the gun G3 by means of control data, and a helicopter 10 carrying the common measuring target Z suspended there from e.g. on the suspending wire or cable 12. The respective two mounts for the aiming or fire control device and the gun G3 are positioned at their platforms or seatings on the deck S and, as mentioned, are mechanically roughly aligned. This approximate or coarse position has been measured with usual precision according to part 2 of the entire process and has been taken into account from then on. The intrinsic parameters of the mounts, which have been measured very accurately as far as possible (part 1 of the process) are known and are also incorporated or included.

The aiming or fire control device T2 controls the gun G3 via data or signal lines 11. The alignment error vector B32 according to FIG. 1 is therefore determined with this arrangement.

Figure 4A:
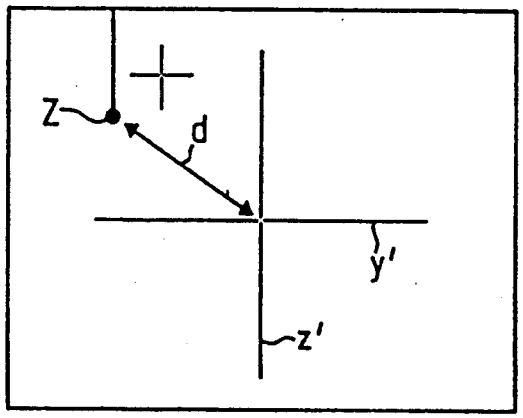
FIGS. 4A and 4B respectively show the result of the single observation shown in FIG. 3 and the display of the result of a complete set of observations obtained by carrying out the exemplary embodiment of the inventive method.
Figure 4B:
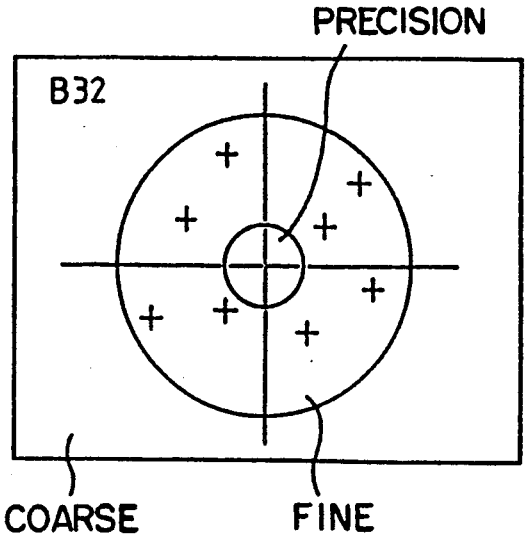

The sensor line of sight of the gun (not the line of sight) is automatically directed to the target in the best possible manner on the basis of the target data determined by the aiming or fire control device and by taking into account all the parameters which are so far known. The intersection point of the reticule therefore indicates the direction in which the common measuring target Z is expected. The common measuring target Z generally will appear in its actual position at a certain offset d from the intersection point of the reticule, for example, in the upper left quadrant of the image in the schematic illustration of FIG. 4A. This immediately visible position error is the result of system errors of any type, such as mechanical tolerances, residual errors of the approximate or coarse position measurement, target tracking errors, etc. The deviations between the gun line of sight as represented by the reticule, and the common measuring target Z are detected at intervals of a few seconds and are stored together with the aiming data of the common measuring target Z which is continually moved through space, by bringing a measuring marker to coincide the common measuring target image or picture by means of a joystick. The corresponding data are stored by actuating a release key. The thus stored set of data from the measurements can be illustrated by, for example 8 measured points as shown in FIG. 4B.

Every new measured value immediately enters into the computation or calculation of the alignment error vector. As the number of measured values obtained for the various directions of the common measuring target Z relative to the aiming or fire control device T2 and the gun G3 increases, the components of the alignment error vector converge. A statistical evaluation of the set of data enables an indication of the quality of the result.

After completion of a measuring series of readings and when the alignment error vector is determined precisely enough, the latter is added to the previous value and the new value is used henceforth, both during the measuring and the firing operations.

Figure 5:
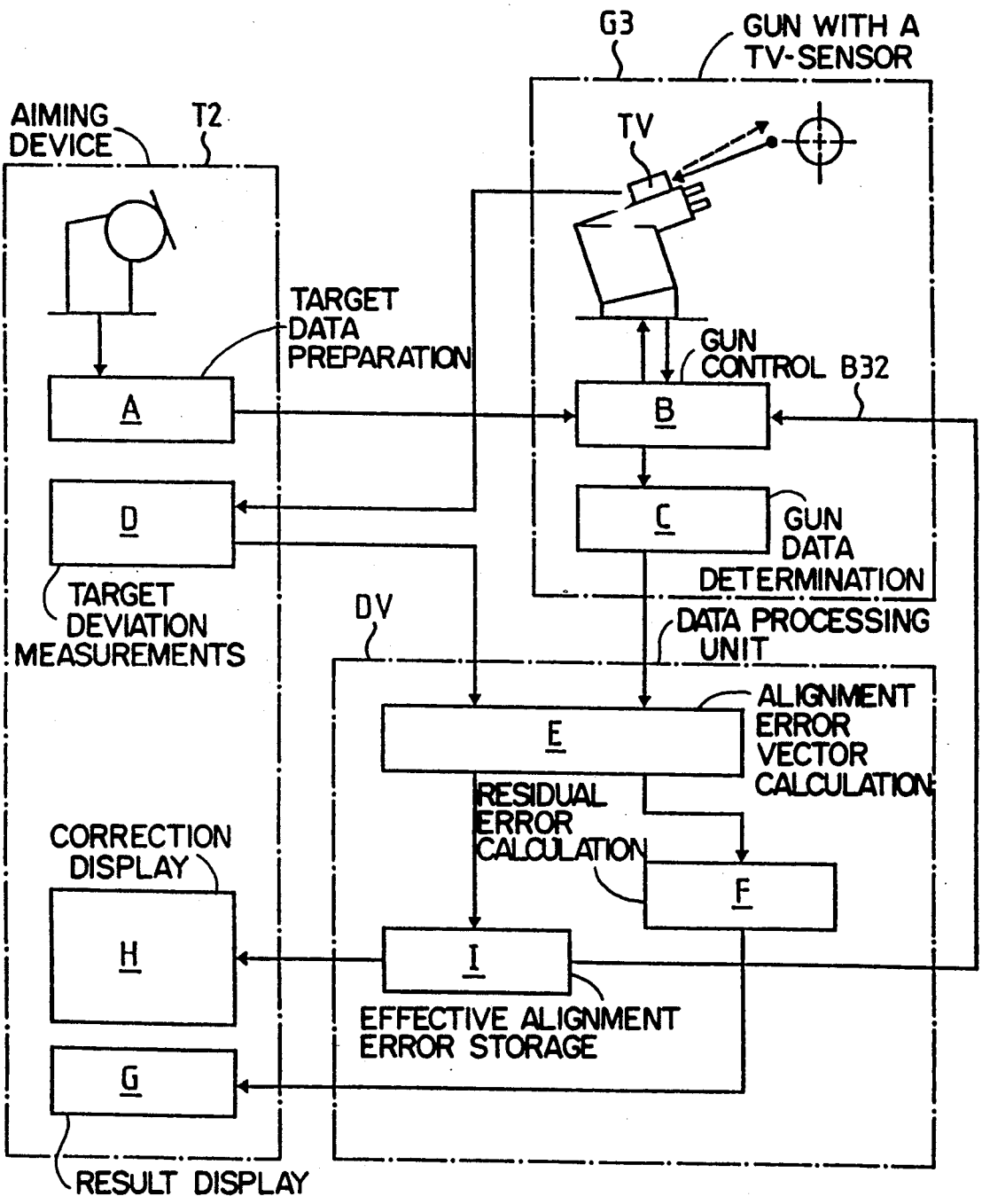
FIG. 5 is a flow chart illustrating the steps of the exemplary embodiment of the inventive method.

The course of such method of determining, for example, the alignment error vector B32 is illustrated in the manner of a flow chart in FIG. 5. The aiming or fire control device T2, the gun G3 with the TV or video target measuring sensor, and a data processing unit or fire control computer DV are connected to one another as shown. Viewed hierarchically, the data processing unit or fire control computer DV is the data manager and data converter for the aiming or fire control device T2. The aiming or fire control device T2 supplies target data for one or more guns.

The various blocks in the flow chart of FIG. 5 are consecutively designated by the reference characters A to I and have the following meaning or work in the following way:

A—is the target data processor of the aiming or fire control device T2. Therefrom, the target position is communicated;

B—is essentially the gun control. Therein there are taken into account among others, the various parallaxes existing between the target tracking sensor of the aiming or fire control device T2, TV or video target measuring sensor of the gun G3, and the common measuring target Z, as well as the alignment error vector obtained from I hereinbelow between the mount of the aiming or fire control device T2 and the mount of the gun G3;

C—determines the set of data relating to the gun G3, i.e. the angles of azimuth and elevation;

D—contains the measured target deviation data with respect to the reticule as shown in FIG. 4;

E—continually computes or calculates as part of the data processing unit or fire control computer DV the alignment error vector from the collected positional deviation data and directions during the course of the measurements (i.e. during progression of the surveillance measurement with the aid of a program;

F—calculates computes or the residual errors, their standard deviations and mean or average values as well as the convergence of the measuring series;

G—displays the various results and enables estimating the improvement obtained by means of the correction;

H—displays the corrections which have been used in the form of a chronological listing, new results supplementing foregoing results. The display serves as an aid for the user and can be recorded for further analyses;

I—stores the effective alignment error vector. During the measuring process, the available previously computed data are (continuously) used. After completion of the measuring process, the calculated new alignment error vector, which is computed or different from zero due to e.g. ship distortions since the last determination, is cumulated with the aforementioned hitherto used alignment error vector. The cumulated new alignment error vector B32 is conducted back to B for future use during the measuring and firing operations.

The same basic course of events serves to determine the alignment error vector A2 between the surveillance radar R and the aiming or fire control device T2, but here only the azimuth angle is evaluated by the surveillance radar R. The recording of the thus measured values can be effected automatically, since both devices track the common measuring target Z and supply target data independently of each other.

What we claim is:

1. A method of correcting alignment errors between target tracking devices and guns of a weapon system, comprising the steps of:

mounting at least one target sensing device defining at least one sensor line of sight at least at one gun defining a gun line of sight;

aligning said at least one sensor line of sight to the at least one gun line of sight;

separately mounting at least one target tracking device and said at least one gun containing said at least one target sensing device, with the at least one target tracking device in spatially spaced relationship from the at least one gun;

aiming at a common measuring target, said at least one target tracking device and said at least one gun mounted target sensing device;

determining positional deviation data indicative of a positional deviation between measured positions of the common measuring target as determined by means of said at least one target tracking device and as determined by said at least one gun mounted target sensing device;

processing said positional deviation data and thereby determining at least one alignment error vector which includes data concerning mounting errors between the separately mounted at least one target tracking device and the at least one gun;

storing said at least one alignment error vector;

producing, by means of said at least one target tracking device, control signals for aiming said at least one gun at an actual target during a firing operation; and correcting said control signals produced by said at least one target tracking device by means of said stored at least one alignment error vector.

2. The method as defined in claim 1, wherein:

said step of mounting said at least one target sensing device at said at least one gun entails mounting a target measuring sensor defining said sensor line of sight at a gun having a gun line of sight and controlled by a fire control device containing said at least one target tracking device;

said step of aiming at said common measuring target entailing the step of aiming said gun containing said target measuring sensor under the control of said fire control device by means of said at least one target tracking device; and said step of determining said positional deviation data entailing the step of determining positional deviation data indicative of a positional deviation existing between the measured position of the common measuring target as determined by means of said at least one target tracking device of said fire control device and as determined by said target measuring sensor of said gun which is associated with and controlled by said fire control device.

3. The method as defined in claim 1, wherein:

said step of mounting said at least one target sensing device at said at least one gun entails mounting at least one target aiming device and at least one target measuring sensor at said at least one gun;

said step of aiming at said common measuring target entailing the steps of aiming independently of each other said at least one gun mounted target aiming device and said at least one target tracking device; and said step of determining said positional deviation data entailing the step of determining positional deviation data indicative of a positional deviation existing between the measured positions of said common measuring target as determined by means of said at least one gun mounted target aiming device and as determined by means of said at least one target tracking device.

4. The method as defined in claim 1, wherein:

said step of aiming at said common measuring target said at least one target tracking device and said at least one gun containing said at least one target sensing device, entails aiming said at least one target tracking device and said at least one gun at said common measuring target in a multitude of spatially different positions of said common measuring target;

during said step of processing said positional deviation data, processing a multitude of positional deviation data associated with said multitude of spatially different positions of said common measuring target and thereby determining said alignment error vector.

5. The method as defined in claim 4, further including the step of:

selecting, as said multitude of spatially different positions of said common measuring target, substantially equidistant azimuthal angles with respect to said at least one gun to be aimed.

6. The method as defined in claim 4, further including the step of:

selecting, as said multitude of spatially different positions of said common measuring target, substantially equidistant elevational positions with respect to the at least one gun to be aimed.

7. The method as defined in claim 1, wherein:

during said step of aiming at said common measuring target said at least one target tracking device and said at least one gun, moving relative to each other said common measuring target and said at least one target tracking device as well as said at least one gun.

8. The method as defined in claim 7, further including the step of:

moving said common measuring target through space along travel paths.

9. The method as defined in claim 8, further including the step of:

carrying said common measuring target on a helicopter; and moving said helicopter through space along flight paths in order to thereby move said common measuring target through space along said travel paths.

10. The method as defined in claim 1, further including:

said step of determining said positional deviation data encompasses determining and statistically evaluating residual errors in order to thereby obtain a quality factor for each associated pair of said at least one target tracking device and said at least one gun.

11. The method as defined in claim 1, further including:

determining dimensional deviation data indicative of dimensional deviations existing between respective desired and actual dimensional data of at least one mount of said at least one target tracking device and at least one mount of said at least one gun;

determining relative positional data indicative of the relative positions of said at least one mount of said at least one target tracking device and said at least one mount of said at least one gun on said common base; and during said step of determining said positional deviation data, taking into account said dimensional deviation data and said relative positional data.

12. The method as defined in claim 1, wherein:

said step of separately mounting said at least one target tracking device and said at least one gun containing said at least one target sensing device entails mounting on a common base a plurality of target tracking devices and a plurality of guns each of which contains a target sensing device;

said step of aiming at said common measuring target entails aiming said plurality of target tracking devices and said plurality of guns at said common measuring target;

said step of determining positional deviation data entails determining positional deviation data indicative of positional deviations between measured positions of said common measuring target as determined by means of each one of said plurality of target tracking devices and as determined by means of each one of said plurality of gun mounted target sensing devices; and said step of processing said positional deviation data entails determining alignment error vectors for the combinations of each one of said plurality of target tracking devices with each one of said plurality of gun mounted target sensing devices.

13. The method as defined in claim 1, wherein:

said common measuring target is not an actual target which is fired upon.

14. An apparatus for correcting alignment errors between a target tracking device and a gun, comprising:

at least one target sensing device for sensing a predeterminate target;

said at least one target sensing device being mounted on at least one gun defining at least one gun line of sight;

said at least one target sensing device defining at least one sensor line of sight extending at a predeterminate angle relative to said at least one gun line of sight;

at least one target tracking device for detecting and tracking said predeterminate target and separately mounted in spaced relationship from said at least one gun;

said at least one target tracking device controlling an aiming operation of said at least one gun at said predeterminate target;

a common measuring target constituting said predeterminate target and positioned relative to said at least one gun and said at least one target tracking device;

said at least one target tracking device and said at least one target sensing device generating positional data indicative of the position of said predeterminate target;

data processing means connected to said at least one target tracking device and said at least one target sensing device for determining and processing positional deviation data indicative of a positional deviation existing between measured positions of said common measuring target as determined by means of said at least one target tracking device and said at least one target sensing device; and said data processing means containing evaluating means for evaluating and processing said positional deviation data in order to thereby obtain at least one alignment error vector which includes data concerning mounting errors between the separately mounted at least one target tracking device and the at least one gun for use in connection with said aiming operation of said at least one gun.

15. The apparatus as defined in claim 14, further including:

a fire control device containing said at least one target tracking device and controlling said aiming operation of an associated gun; and said at least one target sensing device constituting a target measuring sensor mounted at said gun which is associated with and controlled by said fire control device.

16. The apparatus as defined in claim 15, wherein:

said at least one target measuring sensor comprises a fixed focus television camera containing imaging means; and said fixed focus television camera containing a charge coupled device which constitutes said imaging means.

17. The apparatus as defined in claim 14, wherein:

said gun mounted target sensing device contains a target measuring sensor and a target aiming device controlling the aiming operation of said gun; and said at least one target tracking device constituting a target tracking device operated independently of said gun mounted target sensing device.

18. The apparatus as defined in claim 14, wherein:

said data processing means storing dimensional deviation data indicative of dimensional deviations existing between respective desired and actual dimensional data of said at least one target tracking device and said at least one gun;

said data processing means further storing relative positional data indicative of the relative positions of said at least one target tracking device and said at least one gun; and said data processing means taking into account said dimensional deviation data and said relative positional data during processing of said positional deviation data for obtaining said at least one alignment error vector.

19. The apparatus as defined in claim 14, further including:

servo control means interconnected between said at least one gun and said at least one target tracking device;

said at least one target tracking device generating servo control signals for said servo control means for controlling the aiming operation of said at least one gun; and said servo control means being connected to said data processing means for taking account of the at least one alignment error vector during said aiming operation.

20. The apparatus as defined in claim 14, wherein:

said at least one target sensing device being connected to display means displaying a target marker and said gun line of sight.

21. The apparatus as defined in claim 14, further including:

displacing means for moving said common measuring target through space while airborne in any desired manner relative to said at least one target tracking device and said at least one gun.

22. The apparatus as defined in claim 21, wherein:

said common measuring target possesses a radar reflection area.

23. The apparatus as defined in claim 21, wherein:

said common measuring target possesses an infrared reflection area.

* * * * *